US008785847B2

(12) United States Patent
Kovtoun et al.

(10) Patent No.: US 8,785,847 B2
(45) Date of Patent: Jul. 22, 2014

(54) MASS SPECTROMETER HAVING AN ION GUIDE WITH AN AXIAL FIELD

(75) Inventors: Viatcheslav V. Kovtoun, Santa Clara, CA (US); Philip M. Remes, Berkeley, CA (US); Yevgeniy N. Zhuk, Foster City, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 13/396,982

(22) Filed: Feb. 15, 2012

(65) Prior Publication Data

US 2013/0206973 A1 Aug. 15, 2013

(51) Int. Cl.
*H01J 49/00* (2006.01)
*H01J 49/06* (2006.01)

(52) U.S. Cl.
CPC ..... *H01J 49/063* (2013.01); *H01J 49/062* (2013.01)
USPC ..... 250/292; 250/283

(58) Field of Classification Search
CPC ..... H01J 49/063
USPC ..... 250/283
See application file for complete search history.

(56) References Cited

U.S. PATENT DOCUMENTS

| | | | | |
|---|---|---|---|---|
| 5,572,035 | A | 11/1996 | Franzen | |
| 5,811,800 | A | 9/1998 | Franzen et al. | |
| 5,847,386 | A * | 12/1998 | Thomson et al. | 250/288 |
| 6,111,250 | A | 8/2000 | Thomson et al. | |
| 6,163,032 | A * | 12/2000 | Rockwood | 250/396 R |
| 6,559,444 | B2 | 5/2003 | Franzen | |
| 6,674,071 | B2 | 1/2004 | Franzen et al. | |
| 6,713,757 | B2 | 3/2004 | Tanner et al. | |
| 6,803,565 | B2 | 10/2004 | Smith et al. | |
| 6,815,674 | B1 | 11/2004 | Voss | |
| 7,067,802 | B1 * | 6/2006 | Kovtoun | 250/282 |
| 7,675,031 | B2 * | 3/2010 | Konicek et al. | 250/286 |
| 7,932,487 | B2 * | 4/2011 | Kovtoun et al. | 250/282 |
| 7,982,183 | B2 | 7/2011 | Makarov et al. | |
| 8,124,930 | B2 * | 2/2012 | Wang | 250/292 |
| 2001/0054685 | A1 | 12/2001 | Franzen | |
| 2002/0027196 | A1 | 3/2002 | Shiokawa | |
| 2008/0203293 | A1 * | 8/2008 | Makarov | 250/283 |
| 2010/0059673 | A1 * | 3/2010 | Makarov et al. | 250/283 |
| 2011/0248157 | A1 * | 10/2011 | Sugiyama et al. | 250/282 |
| 2013/0313421 | A1 * | 11/2013 | Taniguchi | 250/281 |

* cited by examiner

*Primary Examiner* — Jack Berman
*Assistant Examiner* — James Choi
(74) *Attorney, Agent, or Firm* — Timothy J. Ohara

(57) ABSTRACT

A mass spectrometer having an ion guide with an axial field is described. The ion guide includes electrodes with longitudinally extending gaps and inserts configured to be proximate to the gaps.

24 Claims, 15 Drawing Sheets

MASS SPECTROMETER HAVING AN ION GUIDE WITH AN AXIAL FIELD

BACKGROUND

Mass spectrometers often employ multipole ion guides to focus and confine ions as they are transported along a path from the ionization source to the mass analyzer. Ion guides generally include a plurality of elongated electrodes (sometimes referred to as rod electrodes) to which oscillatory voltages are applied to establish a radially confining field. In addition to the ion transport function, ion guides may be employed for the radial confinement of ions in a collision cell, in which the internal volume of the ion guide is pressurized with collision gas, and ions entering the ion guide undergo fragmentation via the collision-induced dissociation mechanism.

When ion guides are located in relatively high-pressure regions of the mass spectrometer, such as in chambers adjacent the ionization source or within a collision cell, the initial axial velocities of the incoming ions are sharply reduced due to collisions between the ions and background/collision gas. This reduction in ion axial velocity results in a higher residence time within the interior of the ion guide, which may adversely affect instrument performance. More specifically, prolonged ion residence times within the ion guide may reduce sample throughput, decrease sensitivity, and impose limits on various aspects of operation. In the example of triple quadrupole mass spectrometers operated in multiple reaction monitoring (MRM) mode, slowing of ions within the collision cell or upstream ion guides will lengthen the required dwell time at each precursor-product ion transition, thereby constraining the number of different transitions that may be monitored per unit time.

In order to increase the rate at which ions are axially transported through ion guides, it is known to establish a static axial field along part or all of the ion guide length to urge ions in the direction of the ion guide exit. Various structures and methods have been disclosed in the prior art for producing an axial field of this type (see, e.g. U.S. Pat. Nos. 5,847,386; 6,111,250; 6,713,757; 7,067,802; and 7,675,031, which are hereby fully incorporated by reference herein). However, these structures and methods tend to cause distortion of the radially-confining oscillatory (e.g., radio-frequency (RF)) field, which may result in defocusing of the ion beam and consequent reduction in transmission efficiency. Applicant believes that there is a need in the mass spectrometry art for an ion guide having structures for establishing an axial field that avoids the radial-field distortion effects present in prior art devices.

SUMMARY

An ion guide may include a plurality of electrodes, a plurality of resistive inserts, a RF voltage supply, and a DC voltage supply. The plurality of electrodes may be arranged about a device centerline to form an internal volume. At least two of the electrodes may include a longitudinally extending gap. The electrodes include an inward surface facing the device centerline to form a periphery of the internal volume. The plurality of resistive inserts may be configured to be proximate to at least two of the gaps and radially aligned with respect to the device centerline. The resistive inserts may include an innermost surface that faces the device centerline where the innermost surface is a first distance from the periphery of the internal volume. The RF voltage supply may be configured to apply a RF voltage to the plurality of electrodes that establishes a RF field to radially confine ions. In an embodiment, the RF voltage supply may also be configured to apply the RF voltage to the plurality of resistive inserts. The DC voltage supply may be configured to apply a first DC voltage to a first location of the resistive insert and a second DC voltage to a second location of the resistive insert that establishes an axial electric field gradient along at least a portion of the device centerline. The second DC voltage is different than the first DC voltage and the second location is longitudinally spaced apart from the first location.

A mass spectrometer may include an ionization source, an ion guide, a mass analyzer, and a detector. The ionization source may be configured to ionize molecules. The ion guide may include a plurality of electrodes arranged about a device centerline to form an internal volume. At least two of the electrodes may include a longitudinally extending gap. The electrodes include an inward surface facing the device centerline to form a periphery of the internal volume. A plurality of resistive inserts may be configured to be proximate to at least two of the gaps and radially aligned with respect to the device centerline. The resistive inserts may include an innermost surface that faces the device centerline where the innermost surface is a first distance from the periphery of the internal volume. A RF voltage supply may be configured to apply a RF voltage to the plurality of electrodes that establishes a RF field to radially confine ions. In an embodiment, the RF voltage supply may also be configured to apply the RF voltage to the plurality of resistive inserts. A DC voltage supply may be configured to apply a first DC voltage to a first location of the resistive insert and a second DC voltage to a second location of the resistive insert that establishes an axial electric field gradient along at least a portion of the device centerline. The second DC voltage is different than the first DC voltage and the second location is longitudinally spaced apart from the first location. The mass analyzer may be configured to receive the ionized molecules from the ion guide and filter the ionized molecules so that a subset of ionized molecules having a particular mass to charge ratio passes through. The detector may be configured to receive and measure the ionized molecules from the mass analyzer.

In another embodiment of an ion guide, it includes a plurality of electrodes, a plurality of conductive inserts, a RF voltage supply, and a DC voltage supply. The plurality of electrodes may be arranged about a device centerline to form an internal volume. The internal volume can include a front end configured to allow ions to enter and a back end configured to allow ions to exit. At least two of the electrodes may include a longitudinally extending gap. The electrodes may include an inward surface facing the device centerline to form a periphery of the internal volume. The plurality of conductive inserts may be configured to be proximate to at least two of the gaps and radially aligned with respect to the device centerline. The conductive inserts may include an innermost surface that faces the device centerline. The innermost surface may include a second distance from the periphery of the internal volume at the front end of the ion guide. In addition, the innermost surface may also include a third distance from the periphery of the internal volume at the back end. The second distance at the front end being greater than the third distance at the back end. The RF voltage supply may be configured to apply a RF voltage to the plurality of electrodes that establishes a RF field to radially confine ions. In an embodiment, the RF voltage supply may also be configured to apply the RF voltage to the plurality of conductive inserts. The DC voltage supply may be configured to apply a third DC voltage to the conductive inserts that establishes an axial electric field gradient along at least a portion of the device centerline.

A method of guiding ions in a mass spectrometer may include injecting ions into an ion guide. The ion guide may include a plurality of electrodes and a plurality of inserts. The plurality of electrodes may be arranged about a device centerline to form an internal volume. The internal volume may include a front end configured to allow ions to enter and a back end configured to allow ions to exit. At least two of the electrodes may include a longitudinally extending gap. The plurality of inserts may be configured to be proximate to at least two of the gaps. The inserts may include an innermost surface that faces the device centerline where the innermost surface includes a first distance from a periphery of the internal volume. A RF voltage may be applied to the plurality of electrodes to establish a RF field to radially confine ions. In an embodiment, the RF voltage may also be applied to the plurality of inserts. At least one DC voltage may be applied to the plurality of inserts to establish an axial electric field gradient along at least a portion of the device centerline.

BRIEF DESCRIPTION OF THE DRAWINGS

The accompanying drawings, which are incorporated herein and constitute part of this specification, illustrate presently preferred embodiments of the invention, and, together with the general description given above and the detailed description given below, serve to explain features of the invention (wherein like numerals represent like elements). A detailed understanding of the features and advantages of the present invention will be obtained by reference to the following detailed description that sets forth illustrative embodiments, in which the principles of the invention are utilized, and the accompanying drawings of which.

DETAILED DESCRIPTION OF EMBODIMENTS

The following detailed description should be read with reference to the drawings, in which like elements in different drawings are identically numbered. The drawings, which are not necessarily to scale, depict selected embodiments and are not intended to limit the scope of the invention. The detailed description illustrates by way of example, not by way of limitation, the principles of the invention. This description will clearly enable one skilled in the art to make and use the invention, and describes several embodiments, adaptations, variations, alternatives and uses of the invention, including what is presently believed to be the best mode of carrying out the invention. As used herein, the terms "about" or "approximately" for any numerical values or ranges indicate a suitable dimensional tolerance that allows the part or collection of components to function for its intended purpose as described herein.

Figure 1:
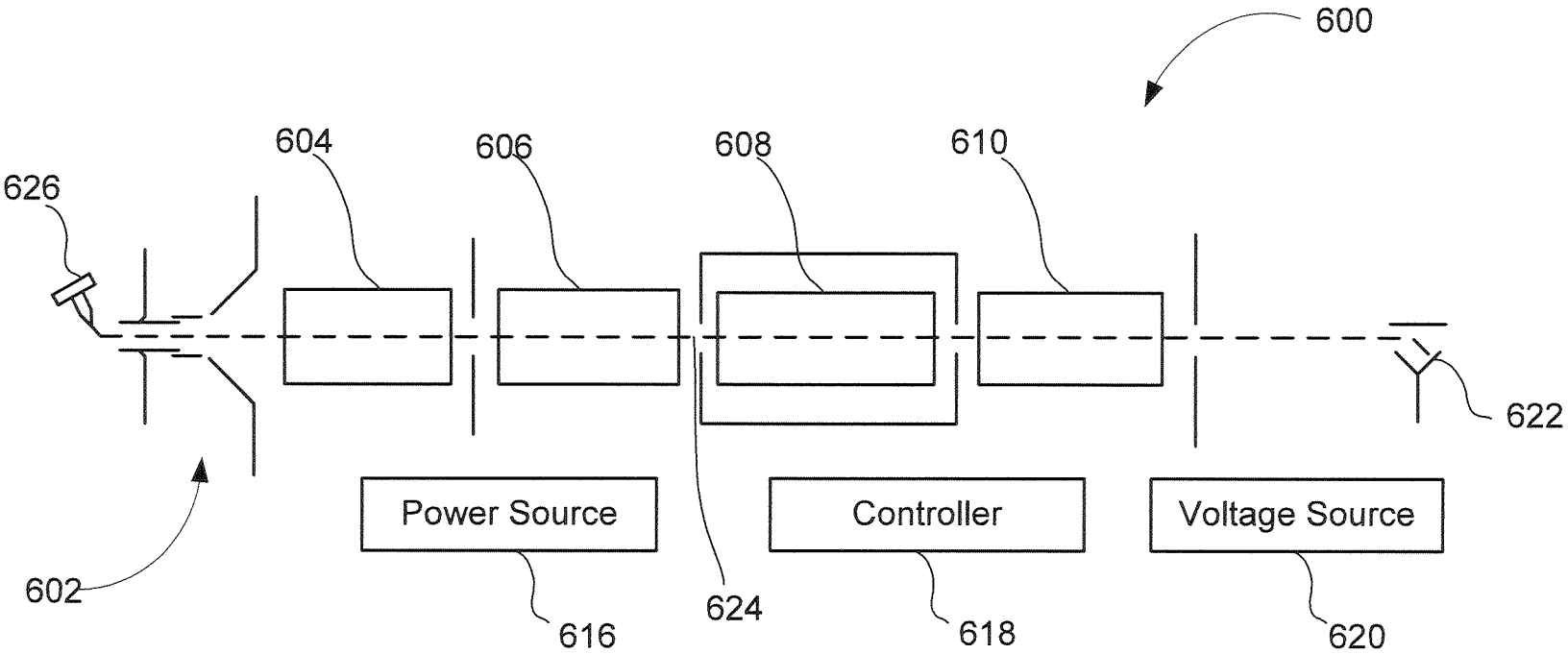
FIG. 1 illustrates a schematic view of a mass spectrometer in which an ion guide constructed in accordance with an embodiment of the invention may be implemented.

FIG. 1 illustrates a schematic view of a triple quadrupole mass spectrometer 600 which may incorporate one or more ion guides constructed in accordance with embodiments of the invention. Mass spectrometer 600 includes an electronic controller 618, a power source 616 configured to supply a RF voltage to the ion guides and quadrupole mass filters, and a voltage source 620 configured to supply one or more DC voltages to various components. Mass spectrometer 600 is configured with an ionization source 626 and an inlet section 602. Examples of ionization sources configured to ionize molecules may include electrospray ionization, chemical ionization, thermal ionization, and matrix assisted laser desorption ionization sources. In addition, mass spectrometer 600 includes ion guides 604 and 608, as well as quadrupole mass filters 606 and 610. As known in the art, each mass filter 606, 610 is configured to selectively transmit a subset of ions having a particular mass to charge ratio (determined by the amplitudes of the applied RF and resolving DC voltages). Ion guide 608 is positioned within a gas-filled enclosure to form a collision cell for controlled dissociation of incoming precursor ions. Ion guides 604, 608, and analyzer 606, 610 define an ion path 624 from the inlet section 602 to at least one detector 622. The detector is configured to receive the ions transmitted along ion path 624 and responsively generate a signal representative of the number of received ions. Any number of vacuum stages may be implemented to enclose and maintain any of the devices along the ion path at a lower than atmospheric pressure. The electronic controller 618 is operably coupled to the various devices including the pumps, sensors, ion source, ion guides, collision cells and detectors to control the devices and conditions at the various locations throughout the mass spectrometer 600, as well as to receive and send signals representing the ions being analyzed.

As discussed in the background section, it may be advantageous to establish an axial DC field within the interior of an ion guide to assist in the movement of ions therethrough and avoid the problems associated with prolonged ion retention. The prior art includes a variety of structures developed for this purpose, but many of these structures produce significant distortion in the symmetry of the radially-confining RF field.

Figure 2:
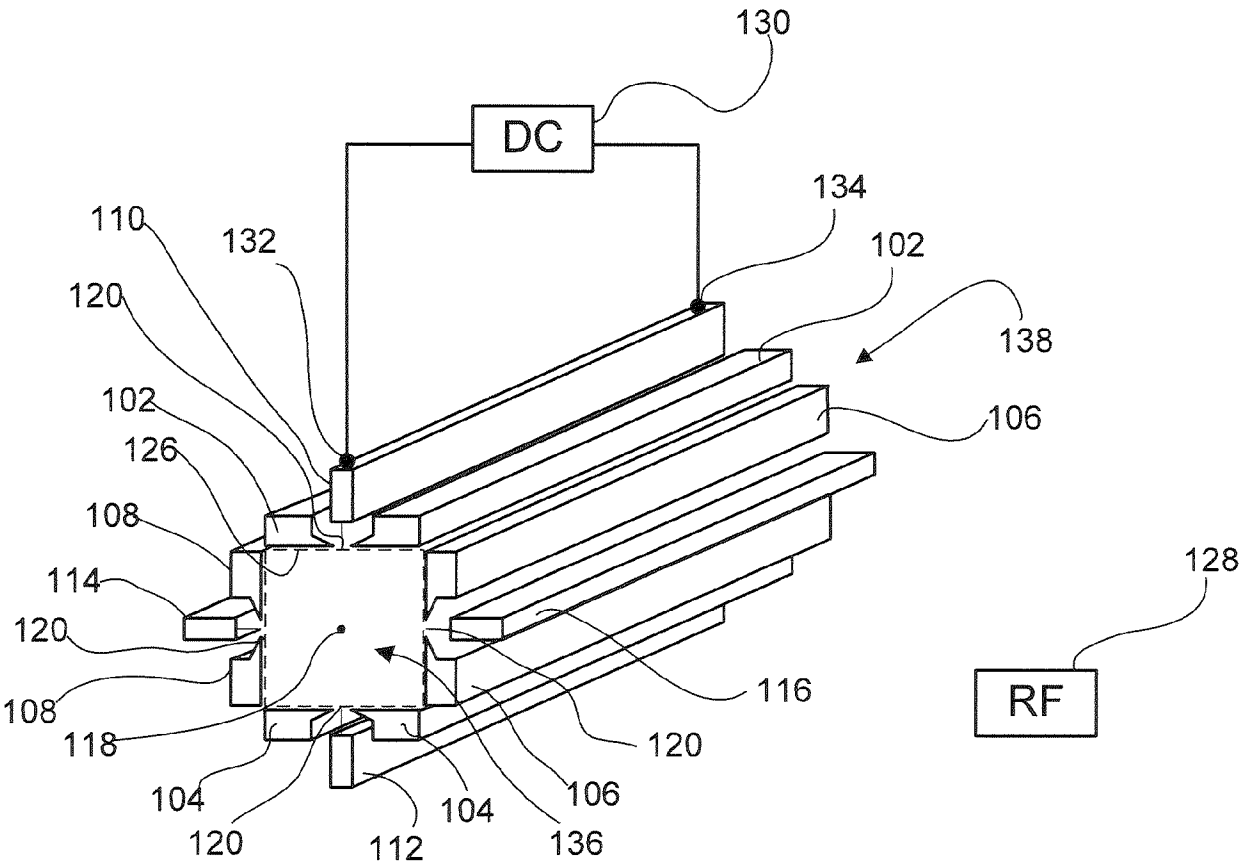
FIG. 2 illustrates a simplified perspective view of an ion guide that includes segmented rectangular electrodes and resistive inserts.

Applicant will describe a multipole ion guide with axial electric fields that move ions through the ion guide, and has reduced distortion of RF fields. As an example, such multipole ion guides may be implemented on mass spectrometer 600 for ion guides 604 and/or 608. FIG. 2 illustrates a simplified perspective view of an ion guide 100, which includes a plurality of electrodes (102, 104, 106, and 108), a plurality of resistive inserts (110, 112, 114, and 116), a DC voltage supply 130, and a RF voltage supply 128. The electrodes depicted in FIG. 2 are in the form of elongated rectangles that are segmented to form a longitudinally extending gap. Ion guide 100 also includes a front end 136 configured for ions to enter and a back end 138 configured for ions to exit. When ion guide 100 is used in a collision cell, it may be further provided with a conduit (not shown) configured to add a collision gas to an internal volume so that precursor ions undergo fragmentation via the collision gas to form product ions that exit a back portion of the ion guide under the influence of the axial electric field gradient. The following will describe in more detail the components and the configuration of ion guide 100.

While the foregoing paragraph describes the implementation of ion guide 100 within a triple quadrupole mass spectrometer 600, it should be understood that this description is provided by way of example only, and does not limit the invention to operation in any particular environment. Those skilled in the art will recognize that embodiments of the invention may be beneficially incorporated into any number of mass spectrometer types and architectures.

Figure 3A:
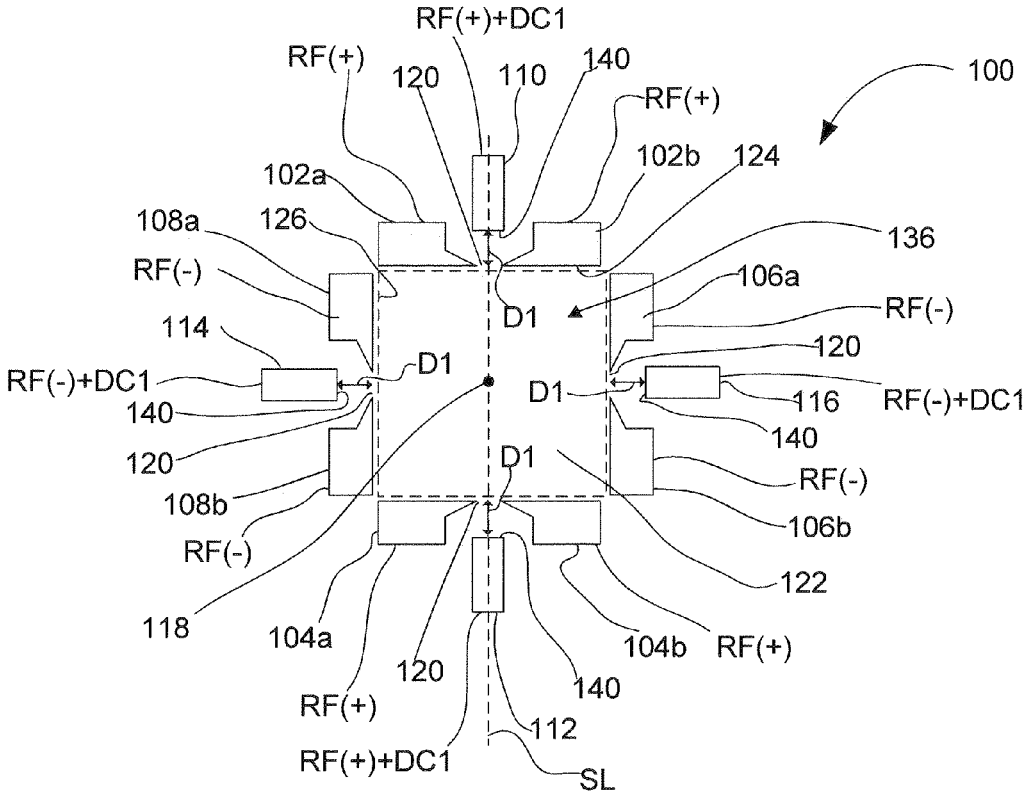
FIGS. 3A and 3B illustrate a front and back end view, respectively, of an ion guide, in accordance with FIG. 2.
Figure 3B:
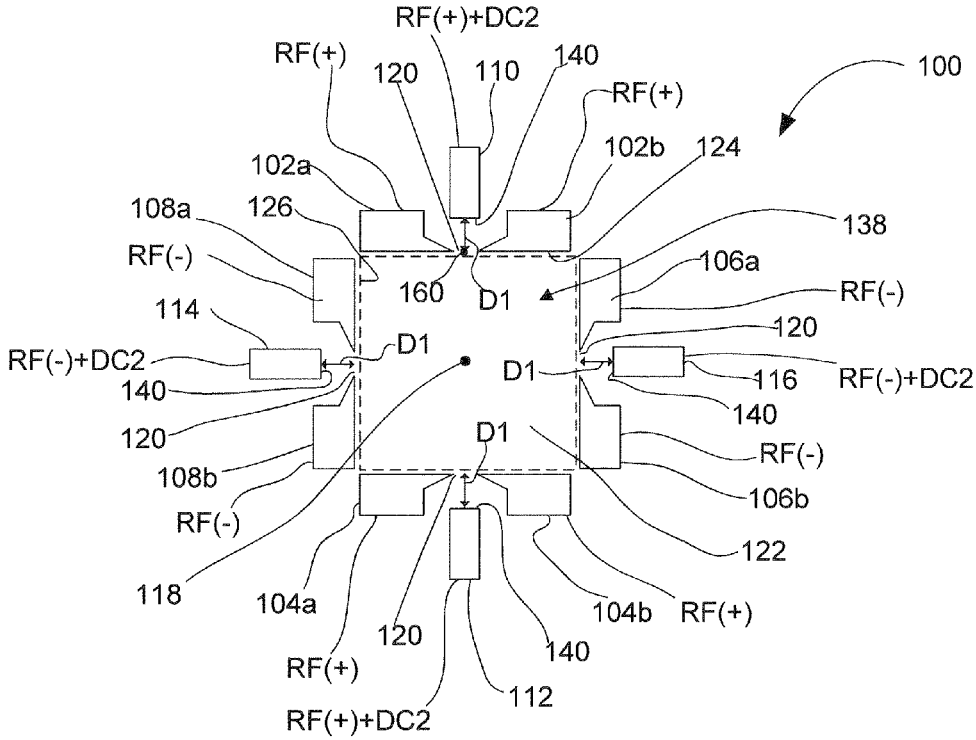

FIGS. 3A and 3B illustrate, respectively, a front end view and a back end view of ion guide 100. Each of the four electrodes (102, 104, 106, and 108) include a longitudinally extending gap 120 that splits the electrode into two separate portions displaced from one another. Within a particular electrode, a first portion can be referred to with the suffix "a" and the other respective corresponding second portion can be referred to with the suffix "b." As illustrated in FIG. 3, a first electrode portion can be 102*a*, 104*a*, 106*a*, and 108*a*, and a respective corresponding second electrode portion can be 102*b*, 104*b*, 106*b*, and 108*b*. As illustrated in FIGS. 2 and 3, the longitudinal gap 120 extends the entire length of the electrode splitting it into separate portions. However, in an alternative embodiment, the longitudinally extending gap does not have to extend the entire length of the electrode and may partially split the electrode into two branches so that they are still electrically connected along a section of an internal volume of the ion guide.

It should be noted that although ion guide 100 is depicted as having four longitudinally extending gaps 120, an alternative embodiment may include only two gaps so long as they are in an opposing relation with respect to the device centerline. Additionally, where the alternative embodiment has four electrodes, the two remaining electrodes will not have a longitudinally extending gap and will be in an opposing relation with respect to the device centerline.

Referring back to FIGS. 2 and 3, the plurality of electrodes (102, 104, 106, and 108) can be arranged about a device centerline 118 to form an internal volume 122. The device centerline 118 can be an approximately straight line that is disposed in a center portion of the internal volume that intersects both front end 136 and back end 138 of the ion guide. In an embodiment, the plurality of electrodes can be symmetrically arranged about the device centerline. The plurality of electrodes and the plurality of resistive inserts may both include an approximately straight longitudinal axis that are approximately parallel to the device centerline. Alternatively, the device centerline may include a curvature where the plurality of electrodes and the plurality of resistive inserts both include a curved longitudinal axis that corresponds to the curvature of the device centerline.

Figure 7:
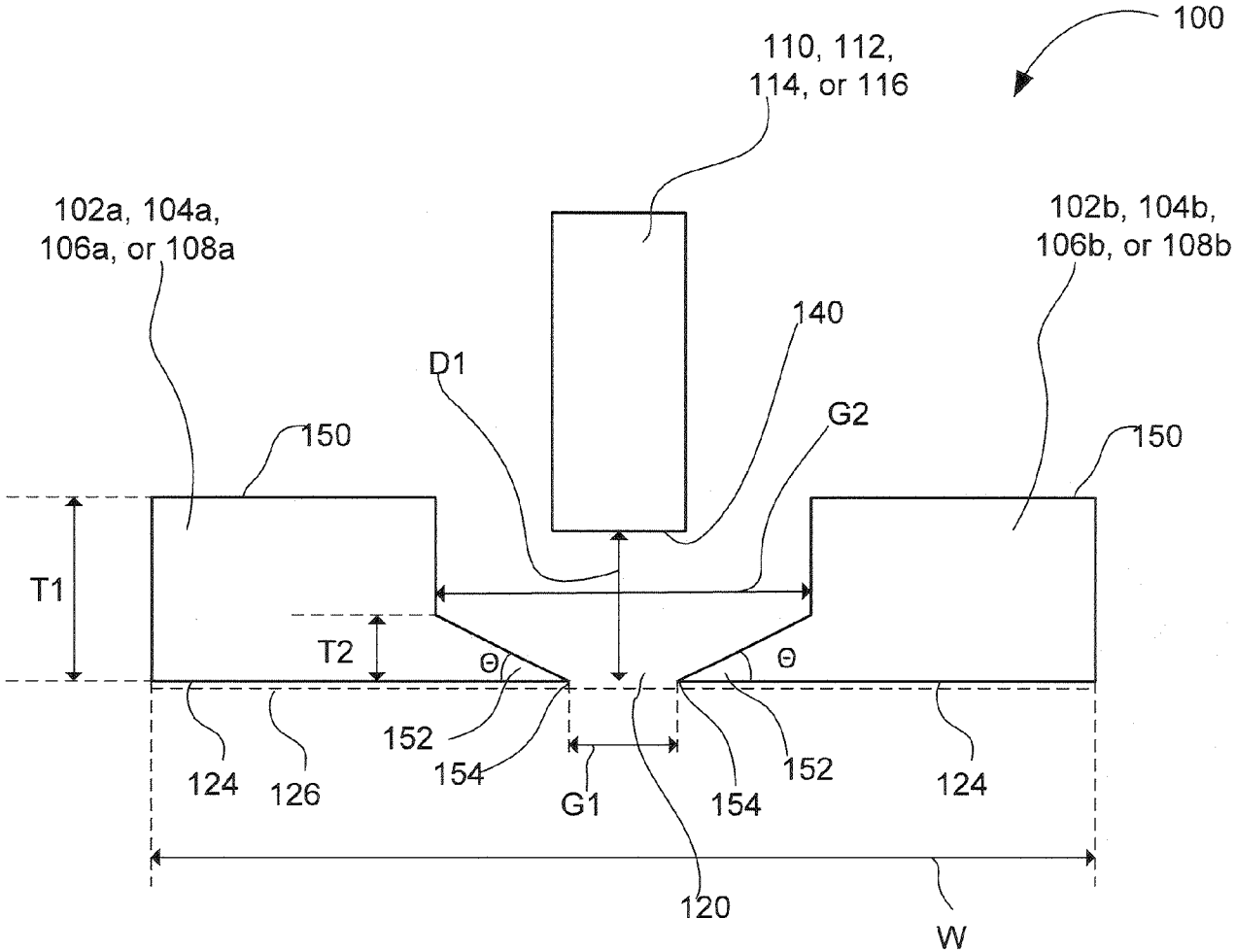
FIG. 7 illustrates a simplified partial end view of the ion guide of FIGS. 2 and 3, which includes a resistive insert and two corresponding electrode portions where the resistive insert is proximate to a longitudinally extending gap.

FIG. 7 illustrates a simplified partial end view of ion guide 100 of FIGS. 2 and 3, which includes a resistive insert (110, 112, 114, or 116) and two corresponding electrode portions (102, 104, 106, or 108, both "a" and "b") where the resistive insert is proximate to a longitudinally extending gap 120. The electrodes can include an inward surface 124 facing the device centerline 118 to form a periphery 126 of internal volume 122. The periphery 126 is denoted as a dotted line in FIGS. 2, 3, and 7. The aggregate of inward surfaces 124 form an outline that defines periphery 126 of the internal volume. Electrode materials may include stainless steel, Invar, or gold coated glass. Invar is a nickel steel alloy that has a relatively low coefficient of thermal expansion (e.g., about 1.2 ppm/° C.). The electrode materials may have a resistivity ranging from about 1 to $10\times10^{-7}$ Ωm.

The inward electrode surface 124 in FIGS. 2, 3, and 7 is essentially flat with gap 120 in between the electrode portions. However, the inward surface does not have to be flat and may be a different shape such as, for example, a curved surface from a cylinder and a hyperbolic surface. In an embodiment, the electrodes may be elongated rods where the rods can be cylinders, squares, rectangles, or other shape suitable for generating RF fields that can guide ions.

The plurality of resistive inserts (110, 112, 114, and 116) are configured to be proximate to each of the gaps 120, as illustrated in FIGS. 2, 3, and 7. In addition, the resistive inserts (110, 112, 114, and 116) are also radially aligned with respect to device centerline 118. In an embodiment, the resistive inserts (110, 112, 114, and 116) are arranged in pairs in an opposing format with respect to the device centerline 118. For example, a pair of resistive inserts (110 and 112) is arranged such that an approximately straight line (denoted by dotted line SL) intersects the two resistive inserts (110 and 112) and the device centerline 118, as illustrated in FIG. 3A. In addition, the approximately straight line SL goes through the gaps proximate to the pair of respective inserts (110 and 112) without touching the proximate electrodes (102 and 104). In an embodiment, the plurality of resistive inserts are symmetrically arranged about the device centerline. It should be noted that although ion guide 100 is depicted as having four resistive inserts that are proximate to four longitudinally extending gaps 120, an alternative embodiment may include only two resistive inserts that are proximate to two respective gaps so long as they are in an opposing format with respect to the device centerline.

Referring back to FIGS. 3 and 7, the resistive inserts (110, 112, 114, and 116) can include an innermost surface 140 that faces device centerline 118 where innermost surface 140 is a first distance D1 from periphery 126 of internal volume 122. The innermost surface 140 is an approximately flat portion of the resistive insert that is closest to and facing the device centerline 118, as is illustrated in FIG. 7. In an embodiment, the innermost surface of the resistive insert may represent the portion closest to the periphery of the internal volume. The innermost surface does not have to be flat and may be a different shape such as, for example, a curved surface from a cylinder and a hyperbolic surface. In an embodiment, the resistive insert may be elongated rods where the rods can be cylinders, squares, rectangles, or other shape suitable for generating an axial field gradient that can guide ions.

An insert proximate to the gap may represent that a location of the insert is next to, very close in space to, neighboring, or adjacent to the gap. In another embodiment, the resistive insert may be proximate and, in addition to, be partially disposed within the gap. The proximate location of the resistive with respect to the gap can be configured so that a sufficiently strong electric field gradient is generated for moving along ions along the device centerline in order to meet instrument performance targets. In an embodiment, the proximate inserts need to be sufficiently close to the gap so that a sufficiently strong axial electric field can be created to move ions along the device centerline. The magnitude of the first distance D1 range may be influenced by other factors such as DC voltage, electrode thickness, and gap distance.

In an embodiment, first distance D1 can be approximately uniform for the entire length of the resistive insert, as illustrated in FIGS. 3A and 3B. First distance D1 may range from about 0.3 millimeters to about 2 millimeters, and preferably range from about 0.5 millimeter to about 1.0 millimeters. First distance D1 may be sufficiently large so that the resistive insert is not exposed to a RF field gradient that could cause it to dissipate power. However, first distance D1 may be sufficiently small so that the strength of the electrical field effectively transmitted through gap 120 can effectively influence ion movement. It should be noted that configuring a uniform first distance D1 for the length of the resistive insert provides for a simple to make ion guide design and alignment.

Figure 12:
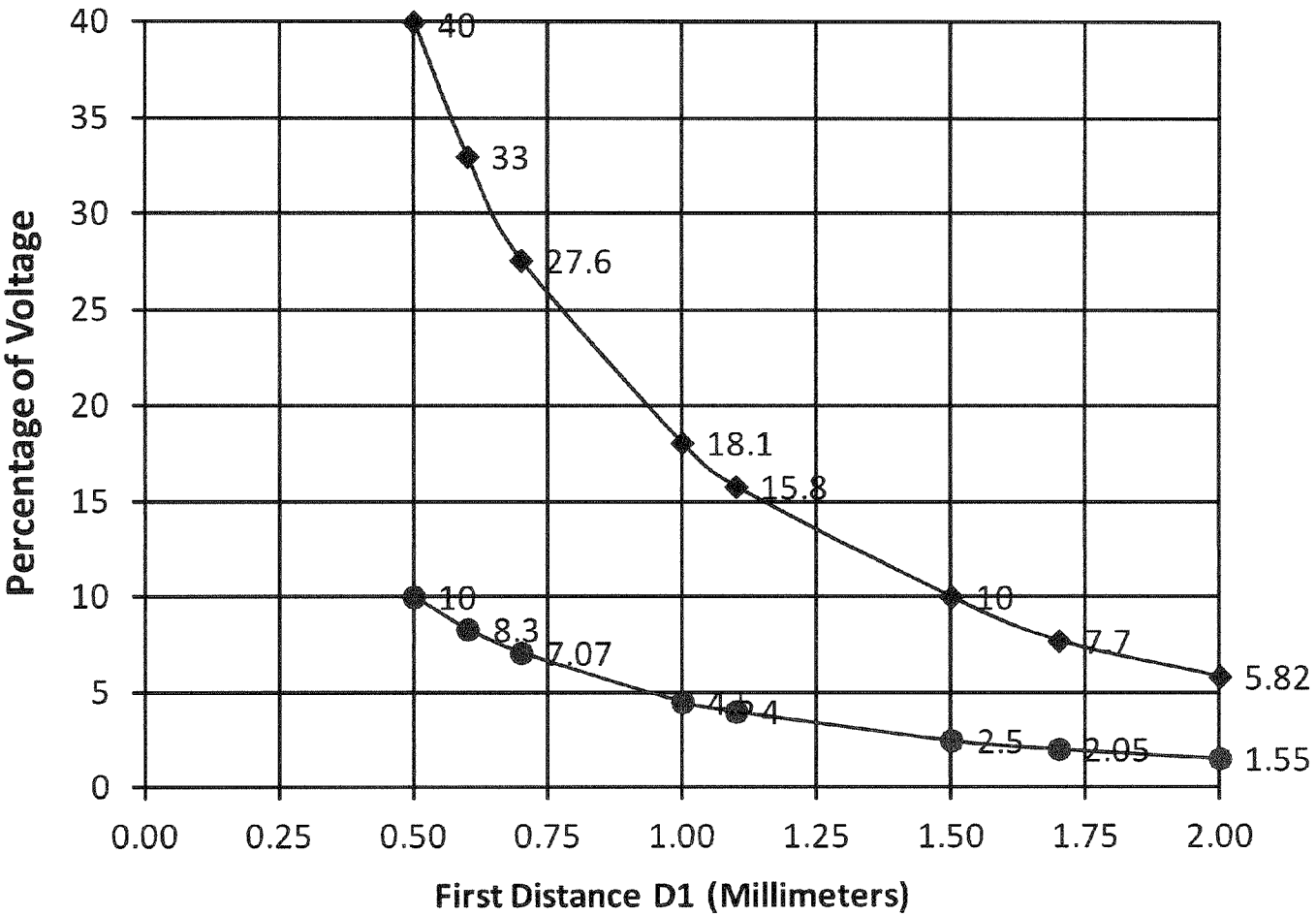
FIG. 12 is a graph illustrating the electric field penetration into an ion guide as a function of the first distance D1.

FIG. 12 is a graph illustrating the electric field penetration as a function of the first distance D1. More particularly, the graph shows the relative magnitude of DC electric potential (the effective field strength) at particular locations in an ion guide. For each value of first distance D1, the graph shows the effective field strength at a center point of the gap at the periphery of the internal volume (diamonds) and also at device centerline 118 (filled circles). The center point of the gap at the periphery of the internal volume for exemplary purposes is denoted as a point 160 in FIG. 3B. The Y-axis in FIG. 12 shows the effective electric field strength as a percentage of the applied DC potential at the resistive insert. In general, the effective electric field strength decreases as the first distance increases.

The resistive insert may be a normal semiconductor, resistive material coated insulator, or a composite material such as resin impregnated with electrically conductive particles (carbon filled PEEK for instance). In an embodiment, the plastic may be an ESd (electrostatic dissipative) material such as, for example, the commercially available Semitron 480 (reinforced polyetheretherketone (PEEK)). The resistive insert may have a surface resistivity ranging from about $10^2$ to about $10^{10}$ ohms per square, and preferably range from about $10^6$ to about $10^{10}$ ohms per square. In an alternative embodiment, the resistive insert may be in the form of a resistive material disposed on a surface of a printed circuit board (PCB). It should be noted that the resistive insert has a simple configuration; it is one continuous part and does not have multiple segmentations with numerous electrical connections (i.e., >2 per insert) to a DC voltage supply.

The resistive insert may have a relatively uniform resistivity along its length so that a gradient field has relatively low distortion. In an embodiment, the resistivity may have a relative variation (about one standard deviation) ranging from about 5% to about 30%, and preferably be less than about 10% for a typical insert having a length of about 10 centimeters.

DC voltage supply 130 may be electrically connected to the plurality of resistive inserts via wires. In an embodiment, a hole may be drilled into the resistive insert and a conductive epoxy, or any other conductive adhesive may be used to secure the wire directly into the resistive insert. In another embodiment, a clip can be used to secure the wire into the hole in the resistive insert or to the body of the resistive insert.

Referring back to FIG. 2, RF voltage supply 128 is configured to apply a RF voltage to the plurality of electrodes (102, 104, 106, and 108). Note that for purposes of simplifying the drawing, the electrical connections of the RF voltage supply 128 to the plurality of electrodes are not shown in FIG. 2. The application of the RF voltage will establish a RF field to radially confine ions along device centerline 118. In an embodiment, an identical RF voltage can be applied to first electrode portion 102*a* and corresponding second electrode portion 102*b*. Since approximately the same polarity, voltage, and frequency are applied to both electrode portions 102*a* and 102*b*, they effectively behave as one electrode 102. In an embodiment, a RF voltage having a first RF potential RF(+) can be applied to one opposed electrode set (102*a*, 102*b*, 104*a*, and 104*b*), and a second RF potential RF(−) can be applied to another opposed electrode set (106*a*, 106*b*, 108*a*, and 108*b*), as shown in FIGS. 3A and 3B. The second RF potential RF(−) may have an amplitude and frequency identical to RF(+), but with a phase opposite to RF(+). RF voltage may include a voltage ranging from about 100 to about 1000 volts and a frequency ranging from about 0.1 MHz to about 5 MHz. Although the RF voltages are expressed in positive numbers, the RF voltage values could also be negative in polarity.

In an embodiment, the RF voltage supply 128 can also be configured to apply a RF voltage to the plurality of electrodes (102, 104, 106, and 108) and the plurality of resistive inserts (110, 112, 114, and 116). A RF voltage having a first RF potential RF(+) can be applied to electrodes 102*a*, 102*b*, 104*a*, and 104*b*, and resistive inserts 110 and 112, as shown in FIGS. 3A and 3B. In addition, a RF voltage having a second RF potential RF(−) can be applied to electrodes 106*a*, 106*b*, 108*a*, and 108*b*, and resistive inserts 114 and 116, as shown in FIGS. 3A and 3B.

It should be noted that the resistive inserts in ion guide 100 are placed in an approximately zero gradient RF region. This is a result of the resistive inserts being placed proximate to the gap of corresponding electrode portions where the same RF potential is applied to the electrode portions and the resistive insert. By placing the inserts in an approximately zero gradient RF region, there is little change in observed capacitance and RF frequencies in the ion guide with and without the application of an axial electric field gradient. It should be noted that the resistive inserts can be made with relatively high dissipative materials for generating drag fields in ion guides when the resistive inserts are disposed in an approximately zero gradient RF region.

Under circumstances where an insert is placed between two RF electrodes that have different RF potentials, a strong RF gradient can exist and cause power to dissipate into the insert. For example, locating a resistive insert in between electrode portions 102*b* and 106*a* would cause the resistive insert to be in a relatively high RF gradient field. This configuration can cause a RF power dissipation in the resistive plastic. During frequency tuning, this can appear as degradation in the measured signal in the form of significant tune curve peak broadening and higher RF current consumption. A possible result of this power dissipation can be heat buildup and destruction of the insert. For the situation where the inserts are exposed to strong RF gradients or fringing RF fields, applicants believe that the inserts need to be constructed with materials having relatively low dissipation loss factors. In turn, applicants believe that there are a limited number of materials that can be used for resistive inserts that have the appropriate resistivity, dissipative loss factor, and uniform resistivity simultaneously. However, for the embodiments where inserts are disposed proximate to the gap in an approximately zero gradient RF region, applicants believe that many other materials could be used as an insert because materials with higher dissipation loss factors could be used.

In the embodiment where the resistive inserts are disposed proximate to the gap, the dissipation loss factor of the resistive insert may be greater than about 0.01, and be about 0.266 at 1 MHz for Semitron 480 in the embodiment.

DC voltage supply 130 is configured to apply a DC voltage difference along each one of the plurality of resistive inserts (110, 112, 114, and 116). More particularly, DC voltage supply can apply a first DC voltage DC1 to a first location for each of the resistive inserts (110, 112, 114, and 116) and a second DC voltage DC2 to a second location for each of the resistive inserts, as shown in FIGS. 3A and 3B. For purposes of simplicity, the electrical connections from the DC voltage supply 130 to the first and second location of resistive insert 110 is illustrated in FIG. 2, but not to the other resistive inserts 112, 114, and 116. The application of the DC voltages can establish an axial electric field gradient along at least a portion of the device centerline. The second DC voltage needs to be different than the first DC voltage and the second location needs to be longitudinally spaced apart from the first location. It should be noted that both DC and RF voltages can be applied to the resistive insert, as is shown in FIGS. 3A and 3B. In an embodiment, the difference in the applied voltage from the first location to the second location along the device centerline (e.g., (DC−DC2)/L1) ranges from about 0.5 V/cm to about 5 V/cm. For example, where L1 is about 10 centimeters, the difference in the applied voltage from the first location to the second location ranges from about 5 Volts to about 50 Volts.

It should be noted that the arrangement of resistive inserts in ion guide 100 with the DC voltage difference provides a low distortion in RF field, with the distortion appearing in the dodecapolar non-linear term. In contrast, the tilted and tapered electrode configurations described in U.S. Pat. Nos. 5,847,386 and 6,111,250 provide a higher distortion in RF field where the distortion appears in the octupolar term. Electrode geometries that have rotational symmetry along a device centerline will have less RF distortion as compared to electrodes geometries that do not have rotational symmetry such as, for example, the tilted and tapered electrode configurations. As a result, ion guide 100 and others described herein, that have rotational symmetry with respect to the device centerline, provide RF fields with relatively lower distortion caused by the octupolar field component. Reduced contribution of this component to the RF field will diminish negative effects of non-linear resonances on mass dependency in ion transmission.

Figure 4:
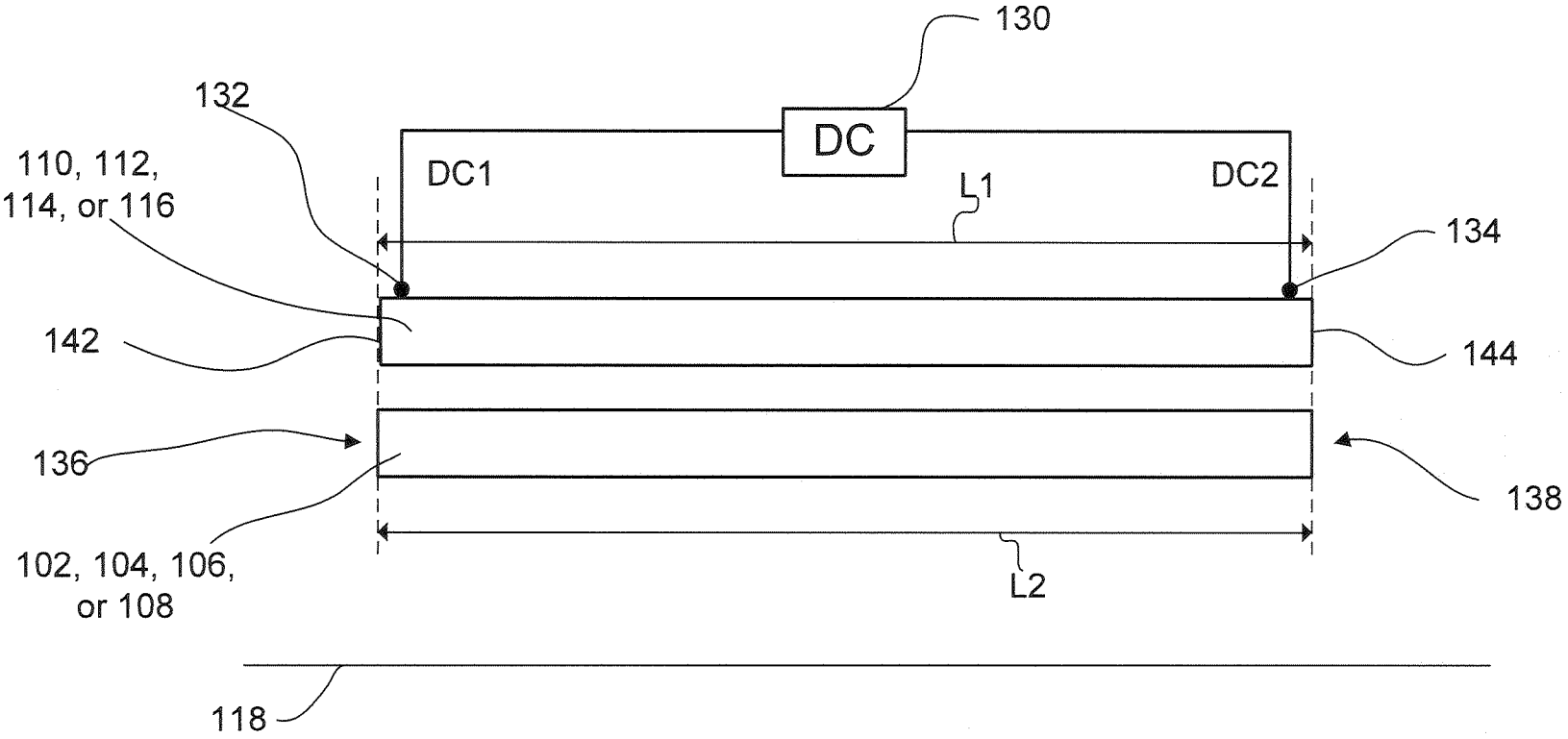
FIG. 4 illustrates a simplified schematic view of a resistive insert and an electrode where both the resistive insert and the electrode have about the same length.

FIG. 4 illustrates a simplified schematic view of an electrode (102, 104, 106, or 108) and a resistive insert (110, 112, 114, or 116) where the length of the electrode and resistive insert are about the same. Although ion guide 100 is shown with four electrodes and four resistive inserts, only one electrode and one insert is shown for illustrative simplicity in FIG. 4. The resistive insert can include a first length L1 and the electrodes can include a second length L2. Both first length L1 and second length L2 can be about the same and approximately parallel to the device centerline 118. First length L1 and second length L2 can both be approximately bounded at front end 136 and back end 138 of the ion guide so that they approximately correspond with a length of the internal volume. First length L1 and second length L2 may range from about 2 centimeters to about 20 centimeters. In an embodiment, a first DC voltage DC1 can be applied to first location 132 adjacent to a front end 142 of the resistive insert. A second DC voltage DC2 can be applied to second location 134 adjacent to a back end 144 of the resistive insert.

Figure 5:
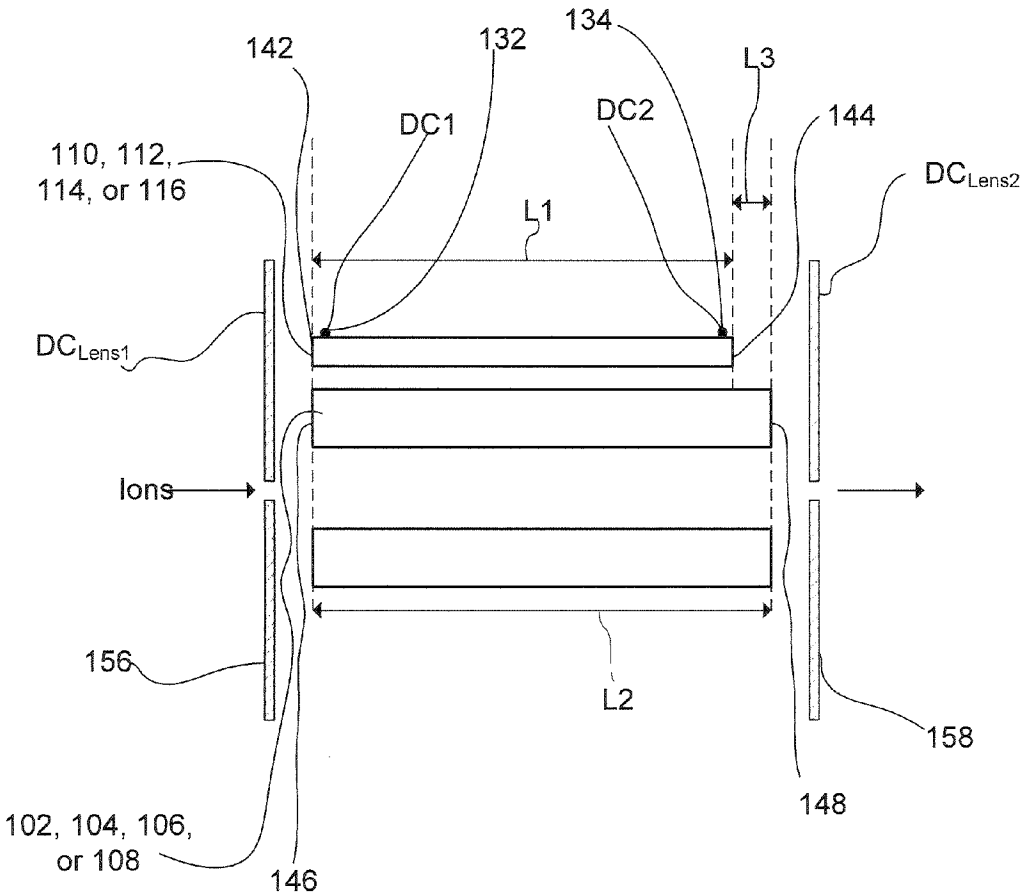
FIG. 5 illustrates a simplified schematic view of a resistive insert and an electrode where a back end of the resistive insert is recessed inward from a back end of the electrode.
Figure 6:
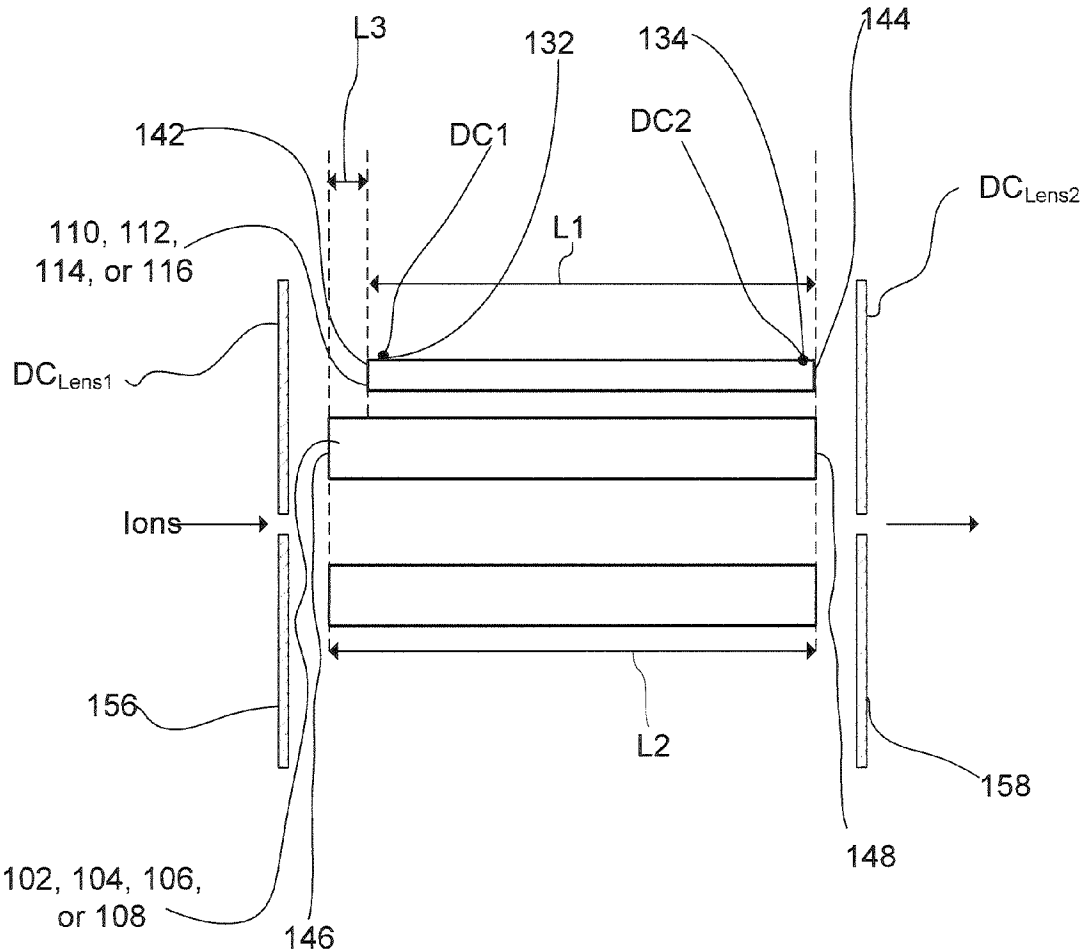
FIG. 6 illustrates a simplified schematic view of a resistive insert and an electrode where a front end of the resistive insert is recessed inward from a front end of the electrode.

Now that the situation has been described where the insert and electrode have about the same length, the following will describe embodiments where the resistive insert length L1 is less than the electrode length L2. More particularly, a back end of the resistive insert can be recessed inward, as illustrated in FIG. 5, and alternatively the front end of the resistive insert can be recessed inward, as illustrated in FIG. 6. Where the back end of the resistive insert is recessed inward, a "push" mechanism is required to move ions along the ion guide. In contrast, where the front end of the resistive insert is recessed inward, a "pull" mechanism is required to move ions along the ion guide.

FIG. 5 illustrates a simplified schematic view of a resistive insert (110, 112, 114, or 116) and an electrode (102, 104, 106, or 108) where a back end 144 of the resistive insert is recessed inward from a back end 148 of the electrode. The first length L1 may be shorter than the second length L2 by a distance ranging from about 2 millimeters to about 5 millimeters. This distance representing the inward recess of the resistive insert may also be referred to as third length L3. Similar to FIG. 4, both first length L1 and second length L2 can be approximately parallel to the device centerline 118. In accordance with FIG. 5, the resistive insert is arranged so that a front end 142 of the resistive insert is approximately aligned with a front end 146 of the electrodes. However, a back end 144 of the resistive insert is not aligned with a back end 148 of the electrodes. The first location 132 is adjacent to front end 142 of the resistive insert and the second location 134 is adjacent to back end 144 of the resistive insert.

Referring back to FIG. 5, the embodiment also includes a first lens 156 and a second lens 158. The first lens 156 is located adjacent to the front end 146 of the electrodes and second lens 158 is located adjacent to the back end 148 of the electrodes. Because the resistive insert is recessed inward at the back end, the ions will be "pushed" through the ion guide so long as the appropriate magnitude and polarity of DC potentials are applied to the first lens $DC_{Lens1}$, first location DC1, second location DC2, the electrodes $DC_{main}$, and preceding ion optics. $DC_{Lens1}$ refers to the DC voltage applied to first lens 156. $DC_{main}$ refers to the DC voltage applied to the electrodes (102, 104, 106, and 108). For the scenario where the ions are positive, then the following condition needs to be satisfied $DC1>DC2>DC_{main}$ for push action so that the ions are sufficiently energized to be pushed through the ion guide. In view of relationship $DC1>DC2>DC_{main}$, an extra local potential barrier occurs on the multipole axis near the DC1 location. Voltages on the preceding ion optics, $DC_{Lens1}$, and $DC_{main}$ are to be set accordingly to provide ions with sufficient energy to compensate for this potential barrier. This voltage difference may be about 0.5 Volts to about 5 Volts.

FIG. 6 illustrates a simplified schematic view of a resistive insert (110, 112, 114, or 116) and an electrode (102, 104, 106, or 108) where a front end 142 of the resistive insert is recessed inward from a front end 146 of the electrode. Third length L3 may approximately correspond as the distance between front end 142 of the resistive insert and the front end 146 of the electrode. In accordance with FIG. 6, the resistive insert is arranged so that a back end 144 of the resistive insert is approximately aligned with a back end 148 of the electrodes. However, a front end 142 of the resistive insert is not aligned with a front end 146 of the electrodes.

Referring back to FIG. 6, the embodiment also includes a first lens 156 and a second lens 158 that is configured in a manner similar to the embodiment in FIG. 5. For the situation where the resistive insert is recessed inward at the front end, this will cause ions to be "pulled" through the ion guide so long as the appropriate magnitude and polarity of DC potentials are applied to the first location DC1, second location DC2, second lens $DC_{Lens2}$, the electrodes $DC_{main}$, and downstream ion optics. $DC_{Lens2}$ refers to the DC voltage applied to second lens 158. For the scenario where the ions are positive and both DC1 and DC2 are less than zero, then the following condition needs to be satisfied $DC2<DC1<DC_{main}$ so that ions are sufficiently energized to be pulled through the ion guide. A minimum potential can form in the ion guide near the back end of the resistive insert where DC magnitude from resistive insert is at the lowest. The distance between the back end of the resistive insert and the second lens, and also the DC offset on the second lens, should be low enough to prevent potential well formation.

Referring back to FIG. 7, gap 120 may include a first gap distance G1 that represents a distance between two electrode portions at periphery 126 of the internal volume. In an embodiment, the first gap distance G1 may range from about 0.5 millimeters to about 1.5 millimeters. As the first gap distance G1 decreases, the distortion in the RF field decreases as well as the axial field strength effectively applied by the resistive insert. However, as the first gap distance G1 increases, the distortion in the RF field increases, and the resistive insert can more effectively transmit a stronger axial field through the gap. Thus, a balance must be determined based on the uniformity of the RF field and the ability of the resistive insert to transmit a sufficiently strong axial field.

Under certain circumstances where there is a need for a simple design, an electrode may have uniform thickness where thickness is a distance between an outward surface and inward surface. However, in FIG. 7, the thickness of the electrode is variable across the width W of the electrode. As illustrated in FIG. 7, the electrode can include a first thickness T1, and second thickness T2 at a protrusion portion 152 which illustrates a decreasing thickness at an area close to the gap. In an embodiment, width W may range from 0.4 centimeters to about 1.0 centimeters. Each electrode portion can include a protrusion portion 152 having an angle Θ at a point 154. The angle Θ may range from about 10 degrees to about 50 degrees. The two respective electrode portions can be arranged so that the two points 154 form first gap distance G1. The two respective electrode portions can also be configured to have a larger second gap distance G2 at the outward surface 150. The electrode protrusion includes a smaller second thickness T2 with a progressively decreasing thickness moving towards point 154. A purpose of having the pointed electrode protrusion geometry is to create an effectively thinner electrode thickness proximate to the innermost surface 140 of the insert so that the axial field can be efficiently transmitted through the gap. In addition, this geometry also includes a larger first thickness T1 away from the gap that improves the structural integrity and alignment of the electrodes for robust manufacturing.

Figure 8:
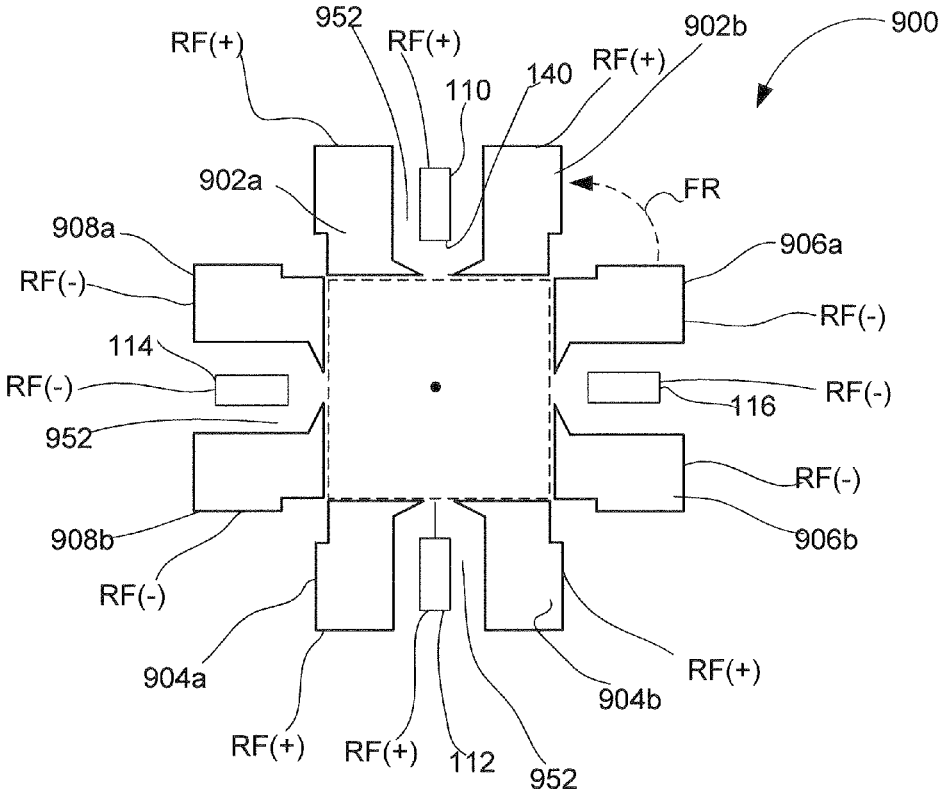
FIG. 8 illustrates another embodiment of an ion guide where the electrodes extend outwardly to screen fringing RF fields at both ends of the ion guide.

FIG. 8 illustrates another embodiment of an ion guide 900, which is similar to ion guide 100, except that the electrodes (902, 904, 906, and 908) extend outwardly to screen resistive inserts (110, 112, 114, and 116) from fringing RF fields. Resistive inserts (110, 112, 114, and 116) may be disposed within a cavity 952. As an example, dotted arrow FR illustrates how the outwardly extending shape of electrode 902*b* can screen a fringing RF from electrode 906*a*. The purpose of the electrode design geometry is to reduce the possibility or exclude dissipative losses at the resistive insert through exposure to RF gradient fields.

Figure 11:
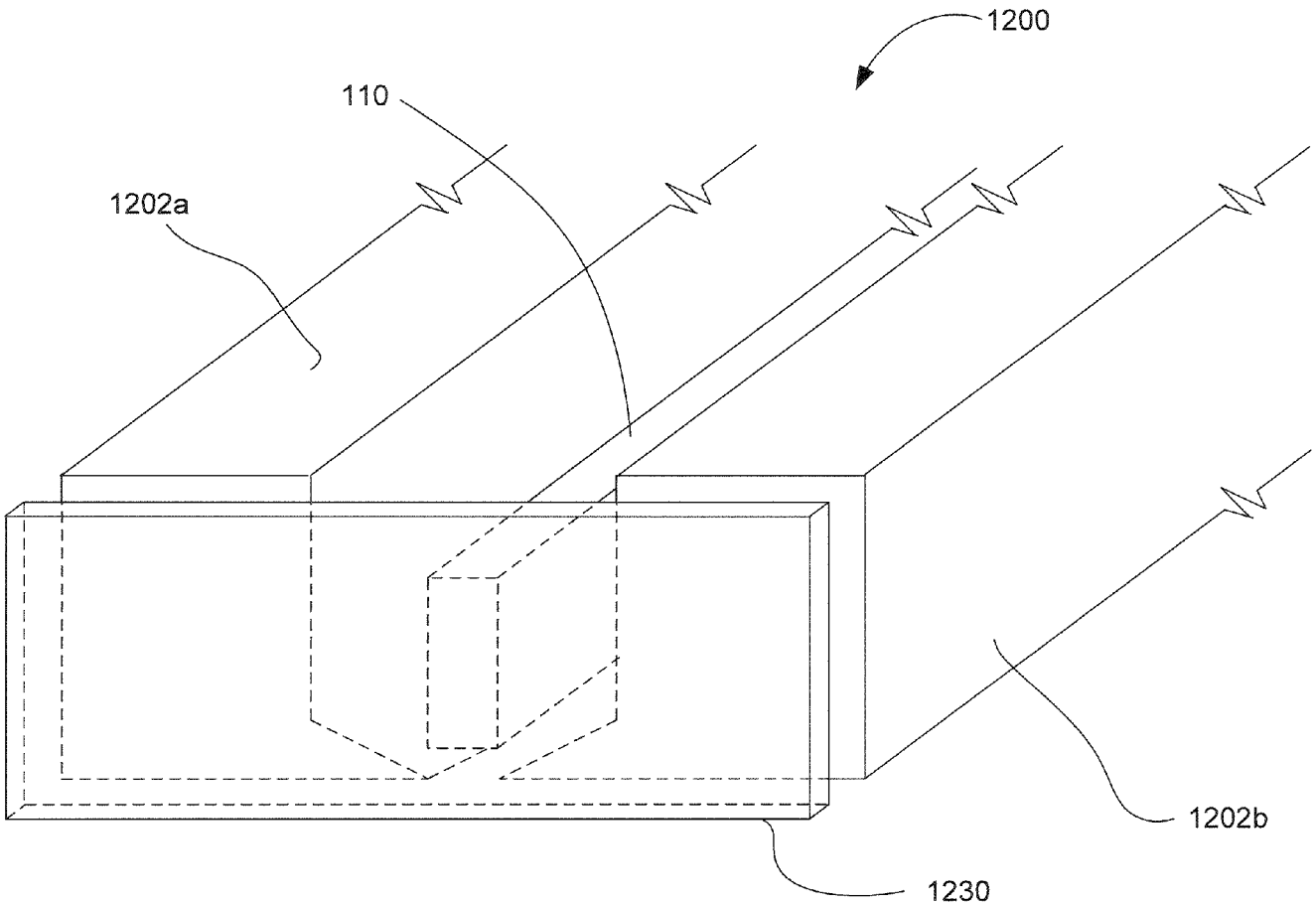
FIG. 11 illustrates a simplified partial end view of an ion guide that includes a front plate.

Under certain circumstances, adjacent devices such as, for example, ion lenses or other quadrupoles can introduce fringing RF fields to a front or back end of an ion guide. To reduce such an effect, a front and back plate may be used for each of the electrodes to screen fringing RF fields. FIG. 11 illustrates a simplified partial perspective view of another embodiment of an ion guide 1200. Ion guide 1200 is similar to ion guide 100, except that each of the electrodes include a front plate and a back plate. The front plate can be located adjacent or attached to a front end of the electrode and the back plate can be located adjacent or attached to the back end of the electrode. As an example, FIG. 11 illustrates electrode 1202*a* and 1202*b* with a front plate 1230 attached to the front end. Resistive insert 110 may be disposed proximate to a longitudinally extending gap. Front plate and the back plate are configured to screen fringing RF field at the front and back ends of the ion guide. If plates are located adjacent, it is preferred that the same or close RF voltage is applied to these plates as the one on the electrodes 1202*a* and 1202*b*. In an embodiment, the front and back plates may be made of the same material as the electrodes.

Figure 9:
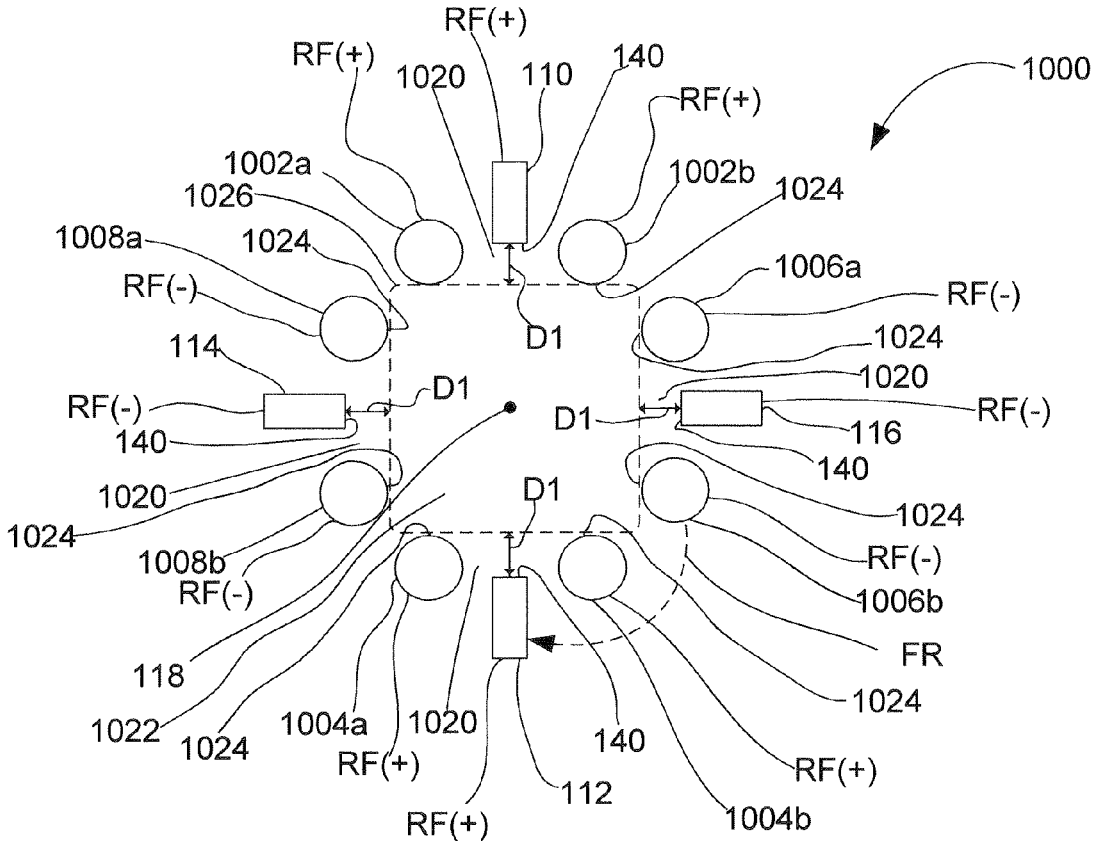
FIG. 9 illustrates an end view of the another embodiment of an ion guide that includes eight elongated rods.

FIG. 9 illustrates a front end view of another embodiment of an ion guide 1000, which is similar to ion guide 100, except that each electrode portion is in the form of an elongated rod 1002*a*, 1002*b*, 1004*a*, 1004*b*, 1006*a*, 1006*b*, 1008*a*, and 1008*b*. The elongated rods are arranged so that each pair of respective electrode portions form one electrode. Within a particular electrode, a first portion can be referred to with the suffix "a" and the other respective corresponding second portion can be referred to with the suffix "b." There is a longitudinally extending gap 1020 that is disposed in between two respective electrode portions. The plurality of electrodes (1002, 1004, 1006, and 1008) can be arranged about a device centerline 118 in an octupolar like configuration to form an internal volume 1022. The resistive inserts (110, 112, 114, and 116) may be proximate to the longitudinally extending gap 1020. The electrodes can include an inward tangential surface 1024 facing the device centerline 118 to form a periphery 1026 of the internal volume. The periphery 1026 is denoted as a dotted line in FIG. 9. The resistive inserts (110, 112, 114, and 116) can include an innermost surface 140 that faces device centerline 118. The innermost surface 140 may be a first distance D1 from periphery 1026 of the internal volume. In an embodiment, first distance D1 can be approximately uniform for the entire length of the resistive insert.

Note that the configuration of ion guide 1000 will have a more open RF gradient field compared to ion guides 100 and 900. For example, RF field gradient between electrodes 1002*b* and 1006*a* will propagate further into the location of resistive insert 110 because the open geometry of electrode 1002*b* does not completely shield resistive insert 110. However, ion guide 1000 can still be a viable device so long as the resistive insert has as a sufficiently low dissipation loss factor.

Figure 13:
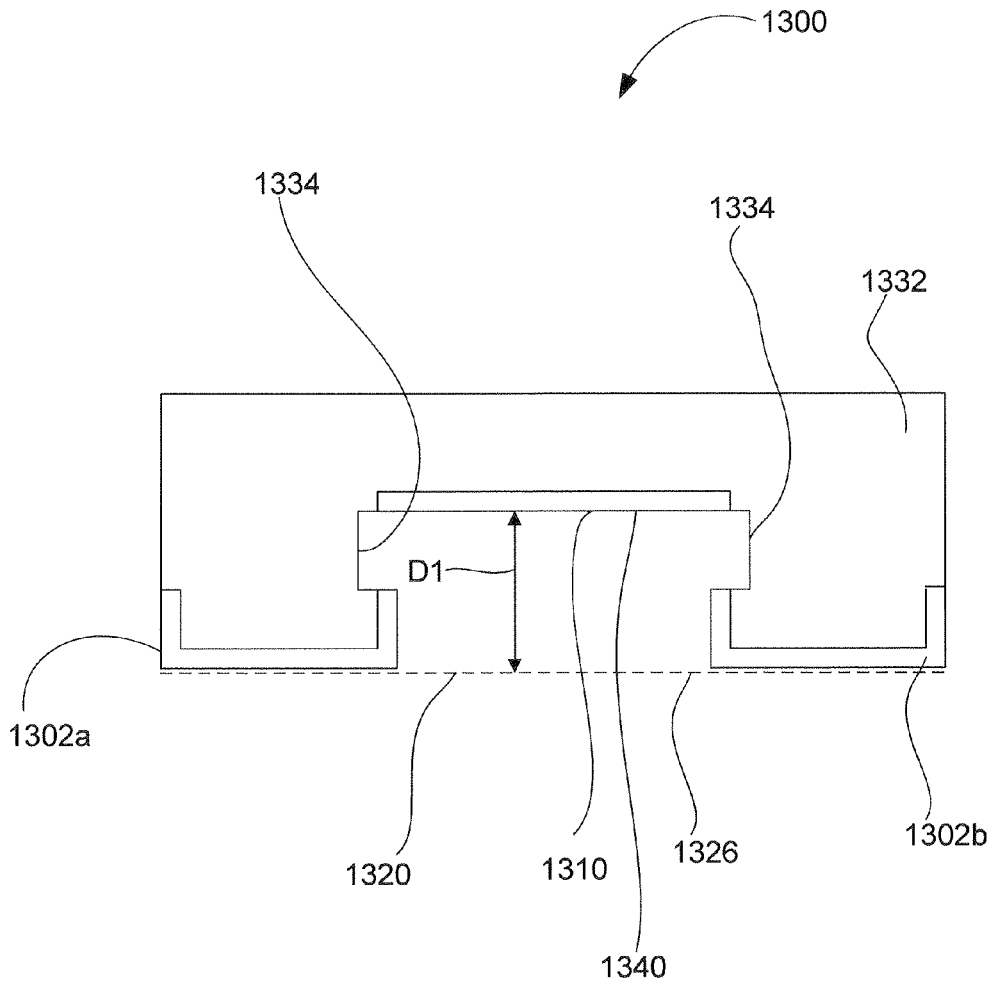
FIG. 13 illustrates a simplified partial end view of another embodiment of an ion guide where the electrodes and resistive inserts are integrated into a PCB.

FIG. 13 illustrates another embodiment of an ion guide 1300. Ion guide 1300 is similar to ion guide 100 except that the electrodes and resistive inserts have been integrated into a printed circuit board 1332 (PCB). Such an embodiment can provide for a simple to construct and robust configuration because the electrodes and resistive inserts are integrated into a common PCB backbone. For simplification in illustration, only one electrode (1302*a* and 1302*b*) and one resistive insert 1310 is illustrated as an end view of a portion of the ion guide. In constructing an actual ion guide 1300, four electrodes and four resistive inserts can be used and assembled in a manner similar to ion guide 100.

Referring to back to FIG. 13, PCB 1332 includes an electrode 1302 and a resistive insert 1310. Electrode 1302 is segmented into two electrode portions 1302*a* and 1302*b* to form a longitudinally extending gap 1320. Ion guide 1300 also includes an isolator region 1334 that forms a discontinuity between the electrode portion and the resistive insert. Resistive inserts 1310 is proximate to the longitudinally extending gap 1320. The electrodes can include an inward surface facing the device centerline to form a periphery 1326 of the internal volume. The periphery 1326 is denoted as a dotted line. The resistive inserts can include an innermost surface 1340 that faces device centerline. The innermost surface 1340 may be a first distance D1 from periphery 1326 of the internal volume. In an embodiment, first distance D1 can be approximately uniform for the entire length of the resistive insert.

Figure 10A:
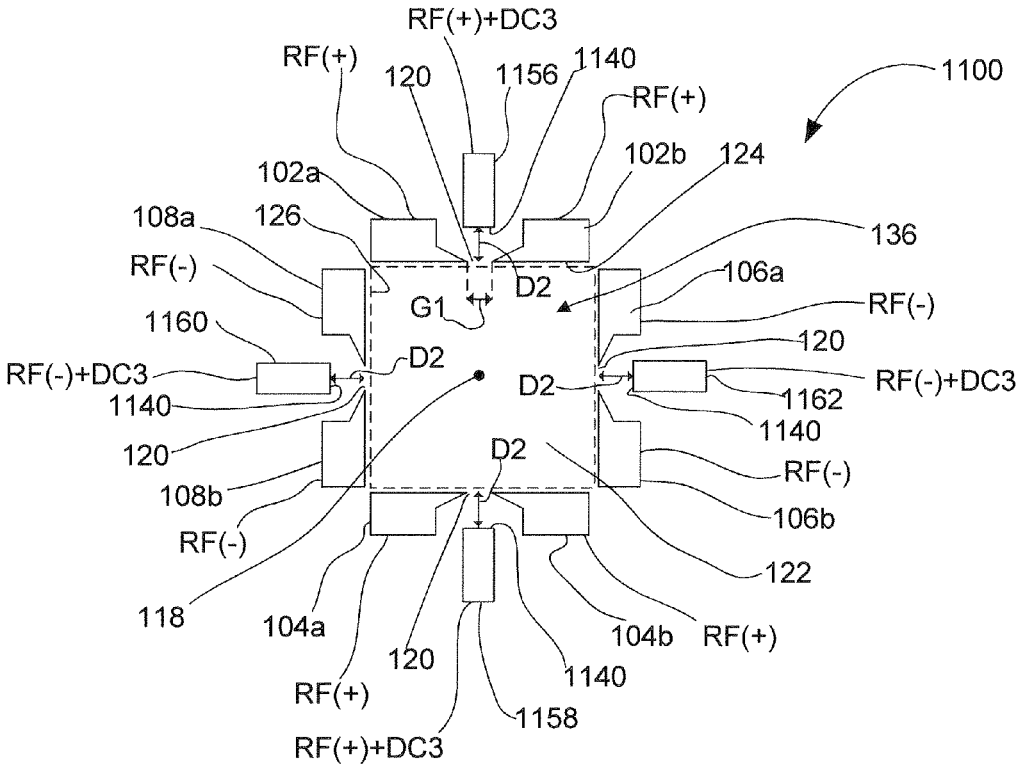
FIGS. 10A and 10B illustrate a front and back end view, respectively, of another embodiment of an ion guide that includes conductive inserts.
Figure 10B:
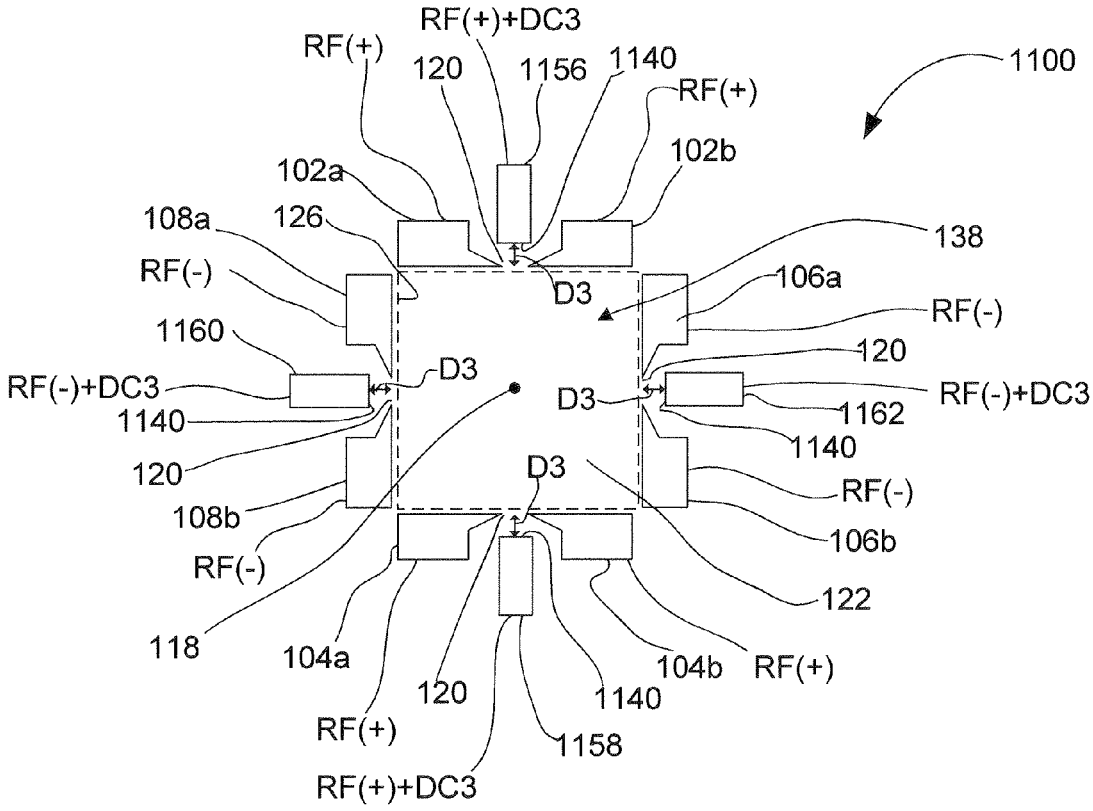

Now that various ion guides with resistive inserts have been described, the following will describe an ion guide 1100 constructed in accordance with a different embodiment of the invention that includes conductive inserts. In general, ion guide 1100 is similar to ion guide 100 in regards to the electrode shape, structure, and orientation. In contrast to ion guide 100, ion guide 1100 includes inserts that are more conductive than resistive inserts and have a tilted arrangement, as illustrated in FIGS. 10A and 10B. In an embodiment, the conductive inserts include a resistivity range typical of metals such as stainless steel that ranges from about $0.2\times10^{-5}$ Ohm cm to about $1\times10^{-5}$ Ohm cm.

FIGS. 10A and 10B illustrate, respectively, a front end view and a back end view of ion guide 1100. Each of the four electrodes (102, 104, 106, and 108) include a longitudinally extending gap 120 that splits the electrode into two separate portions displaced from one another. Within a particular electrode, a first portion can be referred to with the suffix "a" and the other respective corresponding second portion can be referred to with the suffix "b." The longitudinal gap 120 can extend the entire length of the electrode splitting it into separate portions. It should be noted that although ion guide 1100 is depicted as having four longitudinally extending gaps 120, an alternative embodiment may include only two gaps so long as they are in an opposing format with respect to a device centerline 118.

Referring back to FIGS. 10A and 10B, the plurality of electrodes (102, 104, 106, and 108) can be arranged about a device centerline 118 to form an internal volume 122. The internal volume includes a front end 136 configured to allow ions to enter and a back end 138 configured to allow ions to exit. The electrodes include an inward surface 124 that faces the device centerline to form a periphery 126 of the internal volume 122.

A plurality of conductive inserts (1156, 1158, 1160, and 1162) can be configured to be proximate to the longitudinally extending gaps 120, as illustrated in FIGS. 10A and 10B. It should be noted that although ion guide 1100 is depicted as having four conductive inserts that are proximate to four longitudinally extending gaps, an alternative embodiment may include only two conductive inserts that are proximate to two respective gaps so long as they are in an opposing format with respect to the device centerline.

As illustrated in FIGS. 10A and 10B, the conductive inserts (1156, 1158, 1160, and 1162) can include an innermost surface 1140 that faces device centerline 118. FIG. 10A illustrates a second distance D2 that represents a distance between innermost surface 1140 and periphery 126 at front end 136. FIG. 10B illustrates a third distance D3 that represents a distance between innermost surface 1140 and periphery 126 at back end 138. Because the conductive inserts are configured in a tilted arrangement, the second distance D2 is greater than third distance D3.

The innermost surface 1140 is an approximately flat portion of the conductive insert that is closest to and facing the device centerline 118. In an embodiment, the innermost surface of the conductive insert may represent the portion closest to the periphery of the internal volume. The innermost surface does not have to be flat and may be a different shape such as, for example, a curved surface from a cylinder and a hyperbolic surface. In an embodiment, the conductive insert may be elongated rods where the rods can be cylinders, squares, rectangles, or other shape suitable for generating an axial field gradient that can guide ions.

In an embodiment, second distance D2 may range from about 1 millimeter to about 2 millimeters and third distance D3 may be about 0.5 millimeters for a conductive insert having a length of about 10 centimeters. The orientation slope of the conductive insert may range from about 0.005 milliradians to about 0.015 milliradians. Conductive insert may be made of material similar to those used for the electrodes and with a similar resistivity range. It should be noted that conductive insert may also be referred to as a metal insert.

Similar to ion guide 100, the RF voltage supply can be configured to apply a RF voltage to the plurality of electrodes (102, 104, 106, and 108) in ion guide 1100. The application of the RF voltage will establish a RF field to radially confine ions along device centerline 118. In an embodiment, a RF voltage having a first RF potential RF(+) can be applied to electrodes 102*a*, 102*b*, 104*a*, and 104*b*, and a RF voltage having a second RF potential RF(−) can be applied to electrodes 106*a*, 106*b*, 108*a*, and 108*b*, as shown in FIGS. 10A and 10B.

In an embodiment, the RF voltage supply 128 can also be configured to apply a RF voltage to the plurality of electrodes (102, 104, 106, and 108) and the plurality of conductive inserts (1156, 1158, 1160, and 1162). A RF voltage having a first RF potential RF(+) can be applied to electrodes 102*a*, 102*b*, 104*a* and 104*b*, and conductive inserts 1156 and 1158. In addition, a RF voltage having a second RF potential RF(−) can be applied to electrodes 106*a*, 106*b*, 108*a*, and 108*b*, and conductive inserts 1160 and 1162. It should be noted that the conductive inserts in ion guide 1100 are placed in an approximately zero gradient RF region. By placing the inserts in an approximately zero gradient RF region, there is little change in observed capacitance and RF frequencies in the ion guide with and without the application of an axial electric field gradient.

DC voltage supply 130 can be configured to apply a static voltage to the plurality of conductive inserts (1156, 1158, 1160, and 1162). The application of the DC voltage can establish an axial electric field gradient along at least a portion of the device centerline. The static voltage may be referred to as a third DC voltage DC3. Where the second distance D2 is greater than third distance D3, the third DC voltage DC3 may range from about −50 to about −5 volts. For the situation where the third DC voltage DC3 is a negative value, a "push" mechanism occurs to move ions along the ion guide.

DC voltage supply 130 may be electrically connected to the plurality of conductive inserts via wires. In an embodiment, a hole may be drilled into the conductive insert and a conductive epoxy, conductive adhesive, or solder may be used to secure the wire to the conductive insert. In another embodiment, a clip can be used to secure the wire into a hole in the conductive insert.

It should be noted that the configuration of ion guide 1100 with conductive inserts does not significantly change tank circuit parameters such as capacitance and RF frequency. Thus, only a relatively small amount of fine tuning is required for a smooth transition between implementing embodiment designs with and without a drag field.

In an embodiment, a method of guiding ions in a mass spectrometer includes injecting ions into an ion guide. A RF voltage can be applied to a plurality of electrodes to establish a RF field to radially confine ions. The RF voltage can also be applied to the plurality of inserts so that they are in an approximately net zero RF field. At least one DC voltage can be applied to the plurality of inserts to establish an axial electric field gradient along at least a portion of the device centerline. The axial field gradient moves the ions along device centerline so that the ions can be ejected. Next, the ejected ions can be measured as a detection current at a detector so that the detection current achieves a steady-state value ranging from about 0.3 to about 1 milliseconds or less.

In an alternative embodiment, an ion guide having conductive inserts may be configured to use a "pull" mechanism for moving ions along. Such an ion guide will have the conductive inserts tapered in an opposite manner than that of ion guide 1100 such that the second distance D2 is less than third distance D3. Thus, in the alternative embodiment where the second distance D2 is less than third distance D3, the third DC voltage DC3 may be a positive value ranging from about +5 to about +50 volts.

While preferred embodiments of the present invention have been shown and described herein, it will be apparent to those skilled in the art that such embodiments are provided by way of example only. Numerous variations, changes, and substitutions will now occur to those skilled in the art without departing from the invention. While the invention has been described in terms of particular variations and illustrative figures, those of ordinary skill in the art will recognize that the invention is not limited to the variations or figures described. In addition, where methods and steps described above indicate certain events occurring in certain order, those of ordinary skill in the art will recognize that the ordering of certain steps may be modified and that such modifications are in accordance with the variations of the invention. Additionally, certain of the steps may be performed concurrently in a parallel process when possible, as well as performed sequentially as described above. Therefore, to the extent there are variations of the invention, which are within the spirit of the disclosure or equivalent to the inventions found in the claims, it is the intent that this patent will cover those variations as well.

What is claimed is:

1. An ion guide comprising:

(a) a plurality of electrodes arranged about a device centerline to form an internal volume, at least two of the electrodes including a longitudinally extending gap, in which the longitudinally extending gap splits the electrode into two portions displaced from one another, the electrodes including an inward surface facing the device centerline to form a periphery of the internal volume;

(b) a plurality of resistive inserts, each configured to be proximate to a gap, and radially aligned with respect to the device centerline, the resistive inserts including an innermost surface that faces the device centerline where the innermost surface is a first distance from the periphery of the internal volume;

(c) a RF voltage supply configured to apply a RF voltage to the plurality of electrodes that establishes a RF field to radially confine ions, wherein the RF voltage supply is also configured to apply the RF voltage to the plurality of resistive inserts; and (d) a DC voltage supply configured to apply a first DC voltage to a first location of the resistive insert and a second DC voltage to a second location of the resistive insert that establishes an axial electric field gradient along at least a portion of the device centerline, in which the second DC voltage is different than the first DC voltage and the second location is longitudinally spaced apart from the first location.

2. The ion guide of claim 1, in which two of the resistive inserts are arranged in an opposing format with respect to the device centerline.

3. The ion guide of claim 1, in which two the resistive inserts are arranged so that an approximately straight line intersects the two resistive inserts and the device centerline and goes through the gaps proximate to the two respective inserts.

4. The ion guide of claim 1, in which the first distance is about the same at both the first and second locations of the resistive insert.

5. The ion guide of claim 1, in which the resistive inserts and the electrodes include a first length and a second length, respectively, that extend approximately parallel with the device centerline and configured so that the first length and the second length are about the same.

6. The ion guide of claim 1, in which the resistive inserts and the electrodes include a first length and a second length, respectively, that extend approximately parallel with the device centerline and configured so that the first length is less than the second length.

7. The ion guide of claim 1, in which the device centerline is approximately straight, and the plurality of electrodes and the plurality of resistive inserts both include a longitudinal axis that is approximately parallel to the device centerline.

8. The ion guide of claim 1, in which the device centerline includes a curvature, and the plurality of electrodes and the plurality of resistive inserts both include a curved longitudinal axis that corresponds to the curvature of the device centerline.

9. The ion guide of claim 1, in which the plurality of electrodes are symmetrically arranged about the device centerline.

10. The ion guide of claim 1, in which the plurality of resistive inserts are symmetrically arranged about the device centerline.

11. The ion guide of claim 1, in which the difference in the applied voltage from the first location to the second location along the device centerline ranges from about 5 V to about 50 V.

12. The ion guide of claim 1, in which the electrodes include an inward surface facing the device centerline having a shape selected from the group consisting of a curved surface from a cylinder, a flat surface, and a hyperbolic surface.

13. The ion guide of claim 1 further comprising a conduit configured to add a collision gas to the internal volume.

14. The ion guide of claim 1, in which the first distance ranges from about 0.5 millimeters to about 1.0 millimeters.

15. The ion guide of claim 1, in which the resistive insert has a resistivity ranging from about 106 to about 1010 ohms per square.

16. The ion guide of claim 1, in which the gap ranges from about 0.5 millimeters to about 1.5 millimeters.

17. The ion guide of claim 1, in which the resistive insert has a resistivity with a relative variation of less than about 10%.

18. The ion guide of claim 1, in which the resistive insert has a dissipation loss factor greater than about 0.01 at 1 MHz.

19. The ion guide of claim 1, in which the resistive inserts are proximate to and at least partially disposed within the gap.

20. The ion guide of claim 1, in which the resistive inserts comprise a plastic.

21. A mass spectrometer comprising:

(a) an ionization source configured to ionize molecules;

(b) an ion guide configured to receive the ionized molecules, the ion guide comprising;

(i) a plurality of electrodes arranged about a device centerline to form an internal volume, at least two of the electrodes including a longitudinally extending gap, in which the longitudinally extending gap splits the electrode into two portions displaced from one another, the electrodes including an inward surface facing the device centerline to form a periphery of the internal volume;

(ii) a plurality of resistive inserts, each configured to be proximate to a gap, and radially aligned with respect to the device centerline, the resistive inserts including an innermost surface that faces the device centerline where the innermost surface is a first distance from the periphery of the internal volume;

(iii) a RF voltage supply configured to apply a RF voltage to the plurality of electrodes that establishes a RF field to radially confine ions, wherein the RF voltage supply is also configured to apply the RF voltage to the plurality of resistive inserts; and (iv) a DC voltage supply configured to apply a first DC voltage to a first location of the resistive insert and a second DC voltage to a second location of the resistive insert that establishes an axial electric field gradient along at least a portion of the device centerline, in which the second DC voltage is different than the first DC voltage and the second location is longitudinally spaced apart from the first location.

(c) a mass analyzer configured to receive the ionized molecules from the ion guide and filter the ionized molecules so that a subset of ionized molecules having a particular mass to charge ratio passes through; and (d) a detector configured to receive and measure the ionized molecules from the mass analyzer.

22. An ion guide comprising:

(a) a plurality of electrodes arranged about a device centerline to form an internal volume, the internal volume including a front end configured to allow ions to enter and a back end configured to allow ions to exit, where at least two of the electrodes including a longitudinally extending gap, in which the longitudinally extending gap splits the electrode into two portions displaced from one another, the electrodes including an inward surface facing the device centerline to form a periphery of the internal volume;

(b) a plurality of conductive inserts each configured to be proximate to a gap, the conductive inserts including an innermost surface that faces the device centerline where the innermost surface includes (i) a first distance from the periphery of the internal volume at the front end, and (ii) a second distance from the periphery of the internal volume at the back end, the first distance being greater than the second distance;

(c) a RF voltage supply configured to apply a RF voltage to the plurality of electrodes that establishes a RF field to radially confine ions, wherein the RF voltage supply is also configured to apply the RF voltage to the plurality of conductive inserts; and (d) a DC voltage supply configured to apply a DC voltage to the conductive inserts that establishes an axial electric field gradient to move ions along the device centerline.

23. A method of guiding ions in a mass spectrometer, the method comprising:

(a) injecting ions into an ion guide, the ion guide comprising:

(i) a plurality of electrodes arranged about a device centerline to form an internal volume, the internal volume including a front end configured to allow ions to enter and a back end configured to allow ions to exit, where at least two of the electrodes including a longitudinally extending gap, in which the longitudinally extending gap splits the electrode into two portions displaced from one another;

(ii) a plurality of inserts, each configured to be proximate to a gap, the inserts including an innermost surface that faces the device centerline where the innermost surface includes a first distance from the device centerline;

(b) applying a RF voltage to the plurality of electrodes that establishes a RF field to radially confine ions;

(c) applying the RF voltage to the plurality of inserts; and (d) applying at least one DC voltage to the plurality of inserts that establishes an axial electric field gradient along at least a portion of the device centerline.

24. The method of claim 23 further comprising:

(e) measuring a detection current at a detector configured to receive ions from the ion guide so that the detection current achieves a steady-state value within 1 milliseconds or less.

* * * * *